US005326463A

United States Patent [19]

Fletcher et al.

[11] Patent Number: 5,326,463

[45] Date of Patent: Jul. 5, 1994

[54] GASOLINE UPGRADING PROCESS

[75] Inventors: David L. Fletcher, Turnersville; Timothy L. Hilbert, Sewell; Michael S. Sarli, Haddonfield; Stuart S. Shih, Cherry Hill, all of N.J.

[73] Assignee: Mobil Oil Corporation, Fairfax, Va.

[21] Appl. No.: 967,322

[22] Filed: Oct. 28, 1992

Related U.S. Application Data

[63] Continuation-in-part of Ser. No. 850,106, Mar. 12, 1992, which is a continuation-in-part of Ser. No. 745,311, Aug. 15, 1991.

[51] Int. Cl.[5] ..... C10G 45/00

[52] U.S. Cl. ..... 208/89; 208/212

[58] Field of Search ..... 208/89, 212

[56] References Cited

U.S. PATENT DOCUMENTS

| | | | |
|---|---|---|---|
| 3,023,293 | 3/1962 | Geerts et al. | 585/749 |
| 3,759,821 | 9/1983 | Brennan et al. | 208/93 |
| 3,767,568 | 10/1973 | Chen | 208/134 |
| 3,923,641 | 12/1975 | Morrison | 208/111 |
| 3,957,625 | 5/1976 | Orkin | 208/211 |
| 4,044,069 | 8/1977 | Bernard et al. | 585/749 |
| 4,049,542 | 9/1977 | Gibson et al. | 208/213 |
| 4,062,762 | 12/1977 | Howard et al. | 208/211 |
| 4,738,766 | 4/1988 | Fischer et al. | 208/68 |
| 4,753,720 | 6/1988 | Morrison | 208/135 |
| 4,827,076 | 5/1989 | Kokayeff et al. | 208/212 |
| 5,143,596 | 9/1992 | Maxwell et al. | 208/89 |

*Primary Examiner*—Helane Myers

*Attorney, Agent, or Firm*—Alexander J. McKillop; Malcolm D. Keen; Jessica M. Sinnott

[57] ABSTRACT

Low sulfur gasoline of relatively high octane number is produced from a catalytically cracked, sulfur-containing naphtha by hydrodesulfurization and treatment over an acidic catalyst, preferably an intermediate pore size zeolite such as ZSM-5 in an octane restoration step, followed by separation of a $C_9$-containing fraction, and recycling the $C_9$-containing fraction to the octane restoration step. A hydrocarbon fraction comprising $C_1$ to $C_3$ hydrocarbons may also be separated from the octane restored product and recycled for purposes of alkylating aromatic hydrocarbons and for this purpose, it may be advantageous to introduce a benzene-rich feed, such as a reformate, to the process. The treatment over the acidic catalyst in the octane restoration step restores the octane loss which takes place as a result of the hydrogenative treatment and results in a low sulfur gasoline product with an octane number comparable to that of the feed naphtha.

18 Claims, 1 Drawing Sheet

FEED
FRESH $H_2$
10
11
55
12
14
OPTIONAL RECYCLE
RECYCLE
38
$H_2$, $C_3$−
32
62
60
24
28
LIGHT REFORMATE
30
$C_3$−
36
34
$C_3$− TO UNSAT GAS PLANT
$C_4$−
46
$C_5$−$C_8$
48
44
52
$C_4$+
42
54
$C_9$+
56

GASOLINE UPGRADING PROCESS

CROSS REFERENCE TO RELATED APPLICATIONS

This application is a continuation-in-part of our prior application Ser. No. 07/850,106, filed on Mar. 12, 1992 pending which, in turn, is a continuation-in-part of our prior application Ser. No. 07/745,311, filed Aug. 15, 1991 pending all incorporated herein by reference in their entireties.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Catalytically cracked gasoline forms a major part of the gasoline product pool in the United States. However, where the petroleum fraction being catalytically cracked contains sulfur, the products of catalytic cracking usually contain sulfur impurities which normally require removal, usually by hydrotreating, in order to comply with the relevant product specifications. These specifications are expected to become more stringent in the future, possibly permitting no more than about 300 ppmw sulfur in motor gasolines; low sulfur levels also result in reduced emissions of CO, $NO_x$ and hydrocarbons. In the hydrotreating of petroleum fractions, particularly naphthas, and most particularly heavy cracked gasoline, the molecules containing the sulfur atoms are mildly hydrocracked so as to release their sulfur, usually as hydrogen sulfide.

In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina. After the hydrotreating operation is complete, the product may be fractionated, or even just flashed, to release the hydrogen sulfide and collect the now sweetened gasoline. Although this is an effective process that has been practiced on gasolines and heavier petroleum fractions for many years to produce satisfactory products, it does have disadvantages.

Cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

Various proposals have been made for removing sulfur while retaining the more desirable olefins. U.S. Pat. No. 4,049,542 (Gibson), for instance, discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a tension between the growing need to produce gasoline fuels with higher octane number and - because of current ecological considerations—the need to produce cleaner burning, less polluting fuels, especially low sulfur fuels. This inherent tension is yet more marked in the current supply situation for low sulfur, sweet crudes.

Processes for treating catalytically cracked gasolines have been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

To increase their octane numbers, naphthas, including light and full range naphthas, may be subjected to catalytic reforming to convert at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Thus, naphthas are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate, octane is increased by treatment of the reformate with ZSM-5.

Aromatics are generally sources of high octane numbers, particularly very high, research octane numbers and are therefore desirable components of the gasoline, pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute, substantial volumes to the gasoline pool, but they do not generally contribute significantly to higher octane values without reforming.

We have demonstrated in our prior co-pending applications Ser. No. 07/850,106, filed on Mar. 12, 1992 and Ser. No. 07/745,311 filed on Aug. 15, 1991 that zeolite ZSM-5 is effective for restoring the octane loss which takes place when the initial naphtha feed is hydrotreated. When the hydrotreated naphtha is passed over the catalyst in the octane restoration step of the process, some components of the gasoline are cracked into lower boiling range materials, if these boil below the gasoline boiling range, there will be a loss in the yield of the gasoline product. If, however, the cracking products are within the gasoline range, a net volumetric yield increase occurs. To achieve this, it is helpful to increase the end point of the naphtha feed to the extent that this will not exceed the gasoline product end point or similar restrictions (i.e. $T_{90}$, $T_{95}$). While the intermediate pore size zeolites such as ZSM-5 will convert the higher boiling components of the feed, a preferred mode of operation would be to increase conversion of the higher boiling components to products which will remain in the gasoline boiling range.

SUMMARY OF THE INVENTION

We have now developed a process for catalytically desulfurizing cracked fractions in the gasoline boiling range which enables the sulfur to be reduced to acceptable levels without substantially reducing the octane number. In favorable cases, the volumetric yield for gasoline boiling range product is not substantially reduced and may even be increased so that the number of octane barrels of product produced is at least equivalent to the number of octane barrels of feed introduced into the operation.

The process may be utilized to desulfurize light and full range naphtha fractions while maintaining octane to obviate the need for reforming such reactions, or at least without the necessity of reforming such fractions to the degree previously considered necessary. Since reforming generally implies a significant yield loss, this constitutes a marked advantage of the process.

According to the present invention, a sulfur-containing cracked petroleum fraction in the gasoline boiling range is hydrotreated under conditions which remove at least a substantial proportion of the sulfur.

For purposes of this invention, the term "hydrotreating" is used as a general process term descriptive of the reactions in which a prevailing degree of hydrodesulfurization occurs.

The octane of the hydrotreated intermediate product is restored by treatment over a catalyst of acidic functionality under conditions which convert the relatively low octane hydrotreated intermediate product fraction to a higher octane value fraction in the gasoline boiling range.

The invention is directed to a process of upgrading a sulfur-containing feed fraction boiling in the gasoline boiling range which comprises:

contacting the sulfur-containing feed fraction with a hydrodesulfurization catalyst in a hydrodesulfurization reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in an octane restoration reaction zone with a catalyst of acidic functionality to convert it to a product comprising a fraction boiling in the gasoline boiling range having a higher octane number than the gasoline boiling range fraction of the intermediate product;

separating a $C_9$-containing fraction from the product of the octane restoration reaction zone by fractionation; and recycling the $C_9$-containing fraction at least one of the reaction zones.

DETAILED DESCRIPTION OF THE INVENTION

Feed

Figure 1:
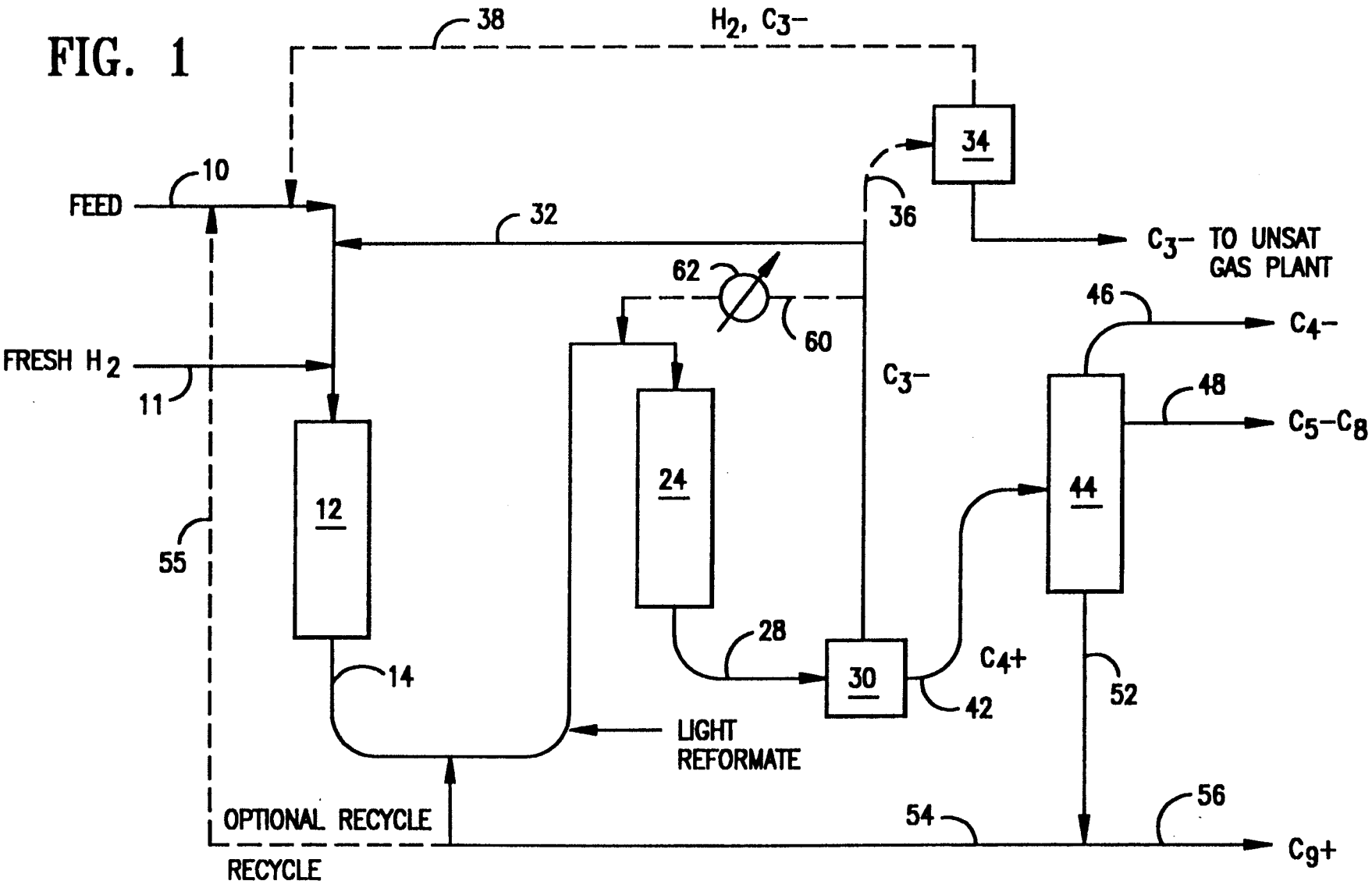
FIG. 1 is a simplified schematic flow diagram of the process of the instant invention.

The feed to the process comprises a sulfur-containing petroleum fraction which boils in the gasoline boiling range. Feeds of this type include light naphthas typically having a boiling range of about $C_6$ to 330 ° F., full range naphthas typically having a boiling range of about $C_5$ to 420 ° F., heavier naphtha fractions boiling in the range of about 260 ° F. to 412 ° F., or heavy gasoline fractions boiling at, or at least within, the range of about 330° to 500 ° F., preferably about 330° to 412 ° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F (about 193° C.) or at least about 400° F. (about 220° C).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g., component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Process Configuration

The instant invention is directed to a process configuration which comprises recycling at least a portion of a $C_9$-containing fraction to the hydrotreating zone. Referring to FIG. 1, the invention includes a hydrotreating zone 12, and an octane restoration zone 24.

The selected sulfur-containing, gasoline boiling range feed and hydrogen are introduced via lines 10 and 11 to the hydrotreating zone 12. In the hydrotreating zone, under hydrotreating conditions, effective contact of the feed with a hydrotreating catalyst is carried out to separate at least some of the sulfur from the feed. The hydrotreating zone is operated under conditions of elevated temperature, elevated pressure and an atmosphere comprising hydrogen to produce a desulfurized intermediate product. The hydrotreating catalyst is suitably a conventional hydrotreating catalyst, such as a combination of a Group VI and a Group VIII metal on a suitable refractory support such as alumina. Under these conditions, the sulfur which is separated is converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

The desulfurized intermediate product is withdrawn from the hydrotreating zone via line 14 and conveyed to the octane restoration zone 24 where it is contacted with a catalyst of acidic functionality under conditions which produce a product comprising a fraction which boils in the gasoline boiling range which has a higher octane number than the portion of the hydrotreated intermediate product fed to this step. The product from the octane restoration zone usually has a boiling range which is not substantially higher than the boiling range of the feed to the hydrotreater, but it is of lower sulfur content while having a comparable octane rating as the result of the octane restoring treatment.

The octane restored product stream is conveyed to a light gas separation zone. 30 to remove light hydrocarbons, particularly $C_3$ and lower ($C_3-$) and $H_2$. The $C_3-$ hydrocarbons are combined with the feed via line 32. Optionally, a portion of the $C_3-$ stream, or the entire $C_3-$ stream, is conveyed to a depropanizer 34 via line 36. The propane/propylene product stream can be conveyed to an alkylation unit to achieve an additional octane gain. The $H_2$ and $C_3-$ effluent of the depropanizer 34 is optionally conveyed to the, hydrotreating zone via line 38. Recycling $H_2$ helps to maintain pressure and reduce operating costs by reducing the amount of fresh hydrogen added to the hydrotreating zone. Since hydrogen is consumed in the hydrotreating zone, recycle hydrogen probably will not significantly reduce the fresh hydrogen requirements.

A heavier hydrocarbon stream ($C_4+$) is conveyed from separation zone 30 via line 42 to fractionation zone 44. A lighter hydrocarbon stream ($C_4-$) is withdrawn via line 46 and can be conveyed to an unsaturated gas plant. High octane gasoline ($C_5$–$C_8$) is withdrawn via line 48. A heavier hydrocarbon stream, particularly a $C_9$ containing stream is withdrawn via line 52 and at least a portion is recycled to the octane restoration zone 24 via line 54 or it can be added to the hydrodesulfurization zone via line 55. Optionally, a portion of the $C_9$-containing stream is conveyed via line 56 for gasoline blending.

Although not shown, it may be useful to incorporate interstage separation of inorganic sulfur and nitrogen as well as light ends and heating of the feed prior to the octane restoration step. However, cascade of the desulfurized effluent directly into the octane restoration step is acceptable.

In an alternative embodiment of the invention, a benzene-rich stream, preferably a benzene-rich reformate fraction or other benzene-rich stream is introduced to the hydrotreating zone 12 or octane restoration zone 24. There, the available paraffins form olefin intermediates which alkylate the aromatics, particularly the benzenes. Olefins can be introduced as a cofeed. When $C_3-$ olefinic hydrocarbons of separator 30 are introduced to octane restoration zone 24 via line 60 they will provide an additional source of olefins. Heat exchanger 62 may be required to maintain the temperature of reaction.

Reformate

The benzene-rich stream can be a reformate. Catalytic reforming of naphtha boiling range feeds to produce high octane reformate is a successful process. However, the process produces a gasoline boiling range fraction which contains large quantities of aromatics, including benzene. The light reformate fraction can be problematic to the refiner since this $C_6-$ fraction sometimes has a lower octane than desired, i.e. it can be lower than the octane of the $C_7+$ fraction. The invention proposes a method for lowering the benzene content of this fraction..

Any conventional reformate, such as reformate from a fixed bed, swing bed or moving bed reformer may be used. The most useful reformate is a light reformate. This is preferably reformate having a narrow boiling range, i.e. a $C_6$ and lighter fraction. This fraction is a complex mixture of hydrocarbons recovered overhead by a dehexanizer column. The composition will vary over a wide range, depending upon a number of factors including the severity of operation in the reformer and reformer feed. Sometimes, these streams will have the $C_5$'s, $C_4$'s and lower hydrocarbons removed in the depentanizer and debutanizer. Therefore, usually, the light reformate will contain at least 80 wt. % $C_6$ hydrocarbons, and preferably at least 90 wt. % $C_6$ hydrocarbons.

By boiling range, these fractions can be defined by an end boiling point of about 250° F., and preferably no higher than about 230° F. Preferably, the boiling range falls between 100° F. and 212° F., and more preferably between the range of 150° F. to 200° F. and even more preferably within the range of 160° F. to 200° F.

The addition of reformate will encourage transalkylation of the benzene-rich reformate with olefins made by cracking reactions to make toluenes and ethylbenzenes.

Hydrotreating

The temperature of the hydrotreating step is suitably maintained from about 400° to 850° F. (about 220° to 454° C.), preferably about 500° to 800 ° F. (about 260° to 427° C.) with the exact selection dependent on the desulfurization desired for a given feed and catalyst. Because the hydrogenation reactions which take place in this step are exothermic, a rise in temperature takes place along the reactor; this is actually favorable to the overall process when it is operated in the cascade mode because the octane restoration step is one which implicates cracking, an endothermic reaction. In this case, therefore, the conditions in the hydrodesulfurization step should be adjusted not only to obtain the desired degree of desulfurization but also to produce the required inlet temperature for the octane restoration step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the octane restoration step of the reaction. When operated with interstage separation and heating, control of the exotherm of hydrodesulfurization is obviously not as critical. Operation with interstage separation and heat may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.1^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the octane restoration step of the process. Normally, the denitrogenation which accompanies the desulfurization will result in an acceptable organic nitrogen content in the feed to the subsequent steps of the process; if it is necessary, however, to increase the denitrogenation in order to obtain a desired level of activity in the subsequent step, the operating conditions in the hydrodesulfurization step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an upflow, fixed bed, trickle phase process; an ebullating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the hydrodesulfurization step. Although some decrease in volume occurs as the result of the conversion to lower boiling products ($C_5-$), this is typically not more than 5 volume percent and usually below 3 volume percent and is normally compensated for by the increase which takes place as a result of aromatics saturation. An increase in volume is typical for the octane restoration step of the process where, as the result of cracking the back end of the hydrotreated feed, cracking products within the gasoline boiling range are produced.

Octane Restoration

The hydrotreated intermediate product is passed to the octane restoration step of the process in which isomerization and cracking takes place over a catalyst of acidic functionality.

The effluent from the hydrotreating step may be subjected to an interstage separation in order to remove the inorganic sulfur and nitrogen as hydrogen sulfide and ammonia as well as light ends but this is not necessary and, in fact, it has been found that the effluent of the hydrodesulfurization step can be cascaded directly into the octane restoration step. This can be done very conveniently in a down-flow, fixed-bed reactor by loading the hydrotreating catalyst directly on top of the octane restoration catalyst bed.

The conditions used in the octane restoration step of the process are those which result in a controlled degree of isomerization, back end conversion, at least partially shape-selective cracking of the desulfurized, hydrotreated effluent to produce olefins which restore the octane rating of the original, cracked feed, at least to a partial degree. The reactions which take place include the shape-selective cracking of low octane paraffins to form higher octane products, both by the selective cracking of heavy paraffins to lighter paraffins and the cracking of low octane n-paraffins, in both cases with the generation of olefins. A substantial degree of isomerization of n-paraffins to branched-chain paraffins of higher octane may take place, making a further contribution to the octane of the final product. Other reactions which take place are less selective and effectuate cracking of bulkier, more highly branched paraffins, olefins and cyclics to lighter products useable as high octane gasoline.

The conditions used in the octane restoration step are those which are appropriate to produce the above-mentioned controlled degree of cracking. Typically, the temperature of the octane restoration step will be about 300° to 900 ° F. (about 150° to 480° C.), preferably about 350° to 800 ° F. (about 177° C.). As mentioned above, in one embodiment, a convenient mode of operation is cascading the hydrotreated effluent via line 14a into the octane restoration zone and this implies that the outlet temperature from the hydrodesulfurization zone (or alkylation zone) will set the initial temperature for the octane restoration zone. When cascading from the hydrodesulfurization zone, the feed characteristics and the inlet temperature of the hydrotreating zone, coupled with the conditions used in the hydrodesulfurization step will set the hydrodesulfurization exotherm and, therefore, the initial temperature of the octane restoration. Thus, the process can be operated in a completely integrated manner, as shown below.

The pressure in the octane restoration reaction zone is not critical since. hydrogenation is not desired at this point in the sequence although a lower pressure in this step will tend to favor olefin production with a consequent favorable effect on product octane. The pressure will therefore depend mostly on operating convenience and will typically be comparable to that used in the hydrodesulfurization step (or alkylation step), particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging.

The use of relatively lower hydrogen pressures thermodynamically favors the increase in volume which occurs in the octane restoration step and for this reason, overall lower pressures are preferred if this can be accommodated by the constraints on the aging of the two catalysts. In the cascade mode, the pressure may be constrained by the requirements of the previous step. However, the possibility of recompression in the interstage separation mode permits the pressure requirements to be individually selected, affording the potential for optimizing conditions in each step.

Consistent with the objective of restoring lost octane while retaining overall product volume, the conversion to products boiling below the gasoline boiling range ($C_5$−) during the octane restoration step is held to a minimum. However, because the cracking of the heavier portions of the feed may lead to the production of products still within the gasoline range a net increase in $C_5$+ material may occur during this step of the process, particularly if the feed includes significant amounts of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

Octane Restoration Catalyst

The octane restoration step of the process comprises a catalyst of sufficient acidic functionality to bring about the desired cracking reactions to restore the octane lost in the hydrotreating step.

One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant: 0.016 $sec^{-1}$). The alpha test is described in U.S. Pat. No. 3,354,078 and in *J. Catalysis,* 4, 527 (1965); 6, 278 (1966); and 61,395 (1980), to which reference is made for a description of the test. The experimental conditions of the test used to determine the alpha values referred to in this specification include a constant temperature of 538° C. and a variable flow rate as described in detail in *J. Catalysis,* 61,395 (1980).

The catalyst used in the octane restoration step of the process suitably has an alpha activity of at least about 20, usually in the range of 20 to 800 and preferably at least about 50 to 200. Even higher alpha acitivity catalysts can be used, although it may not be appropriate for this catalyst to have too high an acid activity because it is desirable to only crack and rearrange so much of the intermediate product as is necessary to restore lost octane without severely reducing the volume of the gasoline boiling range product.

The catalyst used in the octane restoration step of the process possesses sufficient acidic functionality to bring about the desired cracking reactions to restore the octane lost in the hydrotreating step. The preferred catalysts for this purpose are the intermediate pore size zeolitic behaving catalytic materials which are exemplified by those acid acting materials having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22. Zeolite MCM-22 is described in U.S. Pat. No. 4,954,325 and U.S. Pat. No. 4,962,256. Other catalytic materials having the appropriate acidic functionality may, however, be employed. A particular class of catalytic materials which may be used are, for example, the large pore size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina, titania and zirconia.

The catalyst used in this step of the process may contain a metal hydrogenation function for improving catalyst aging or regenerability; on the other hand, depending on the feed characteristics, process configuration (cascade or inter-stage separation with heating) and operating parameters, the presence of a metal hydrogenation function may be undesirable because it may tend to promote saturation of olefinics produced in the cracking reactions as well as possibly bringing about recombination of inorganic sulfur. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the octane restoration conversion catalyst will usually be determined by the type of conversion process which is being carried out, such as: a down-flow, liquid phase, fixed bed process; an up-flow, fixed bed, liquid phase process; an ebulating, fixed fluidized bed liquid or gas phase process; or a liquid or gas phase, transport, fluidized bed process, as noted above, with the fixed-bed type of operation preferred.

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the hydrodesulfurization and octane restoration steps, as well as the alkylation step when appropriate, may be the same or different but the exotherm from the hydrotreatment step will normally result in a higher initial temperature for the octane restoration step. Where there are distinct conversion zones, whether in cascade operation or otherwise, it is often desirable to operate the zones under different conditions. Thus, the octane restoration zone may be operated at higher temperature and lower pressure than the hydrodesulfurization in order to maximize the octane increase obtained in this zone.

Further increases in the volumetric yield of the gasoline boiling range fraction of the product, and possibly also of the octane number (particularly the motor octane number), may be obtained by using the $C_3$–$C_4$ portion of the product as feed for an alkylation process to produce alkylate of high octane number. The light ends from the octane restoration step are particularly suitable for this purpose since they are more olefinic than the comparable but saturated fraction from the hydrotreating step.

In one example of the operation of this process, it is reasonable to expect that, with a heavy cracked naphtha feed, the hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the hydrodesulfurization intermediate product by at least about 5%, and, if the sulfur content is high in the feed, that this octane reduction could go as high as about 15%.

The octane restoration stage of the process should be operated under a combination of conditions such that at least about half (½) of the octane lost during hydrodesulfurization operation will be recovered, preferably such that all of the lost octane will be recovered, most preferably that the octane restoration stage will be operated such that there is a net gain of at least about 1% in octane over that of the feed, which is about equivalent to a gain of about at least about 5% based on the octane of the hydrotreated intermediate.

The process should normally be operated under a combination of conditions such that the desulfurization should be at least about 50%, preferably at least about 75%, as compared to the sulfur content of the feed.

We claim:

1. A process of upgrading a sulfur-containing catalytically cracked feed fraction having a 95% point of at least about 325% and boiling in the gasoline boiling range which comprises:

contacting the sulfur-containing catalytically cracked feed fraction with a hydrodesulfurization catalyst in a hydrodesulfurization reaction zone, operating under a combination of elevated temperature, elevated pressure and an atmosphere comprising hydrogen, to produce an intermediate product comprising a normally liquid fraction high in paraffins which has a reduced sulfur content and a reduced octane number as compared to the feed;

contacting at least the gasoline boiling range portion of the intermediate produce in an octane restoration reaction zone with a catalyst of acidic functionality to convert it to a produce comprising a fraction high in olefins boiling in the gasoline boiling range having a higher octane number than the gasoline boiling range fraction of the intermediate product;

separating a fraction which contains a substantial amount of $C_9$ hydrocarbons from the product of the octane restoration reaction zone by fractionation; and recycling at least a portion of the $C_9$ containing fraction to at least one of the reaction zones.

2. The process as claimed in claim 1 in which the $C_9$ containing fraction contains hydrocarbons up to $C_{13}$.

3. The process as claimed in claim 1 in which the $C_9$ containing fraction boils within the range of $C_9$ to 500° F.

4. The process as claimed in claim 1 in which the $C_9$ containing fraction is a $C_9$+ fraction.

5. The process as claimed in claim 1 further comprising separating a hydrocarbon fraction comprising $C_1$ to $C_3$ hydrocarbons from the product of the octane restoration reaction zone and recycling the $C_1$ to $C_3$ fraction to at least one of the reaction zones.

6. The process as claimed in claim 1 which further comprises separating a $H_2$ stream and a hydrocarbon fraction comprising $C_1$ to $C_3$ hydrocarbons from the product of the octane restoration reaction zone and recycling the $H_2$ stream and the $C_1$ to $C_3$ hydrocarbon fraction to the hydrodesulfurization reaction zone.

7. The process as claimed in claim 1 further comprising separating a hydrocarbon fraction comprising $C_1$ to $C_3$ hydrocarbons from the product of the octane restoration reaction zone and recycling the $C_1$ to $C_3$ hydrocarbons to the octane restoration reaction zone.

8. The process as claimed in claim 1 in which the acidic catalyst comprises an intermediate pore size zeolite.

9. The process as claimed in claim 8 in which the intermediate pore size zeolite has the topology of ZSM-5.

10. A process of upgrading a sulfur-containing catalytically cracked feed fraction having a 95% point of at least about 325° F. and boiling in the gasoline boiling range which comprises:

contacting the sulfur-containing catalytically cracked feed fraction with a hydrodesulfurization catalyst in a hydrodesulfurization reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting the intermediate produce in an octane restoration reaction zone with a catalyst of acidic functionality to convert it to a product comprising a fraction boiling in the gasoline boiling range having a higher octane number than the gasoline boiling range fraction of the intermediate product;

separating a fraction which contains a substantial amount of $C_9$ hydrocarbons from the product of the octane restoration reaction zone by fractionation;

recycling at least a portion of the $C_9$ containing fraction to at least one of the reaction zones; and introducing a light olefinic hydrocarbon fraction to the octane restoration reaction zone to further increase octane and reduce product benzene concentration.

11. The process as claimed in claim 10 which further comprises separating a $H_2$ stream and a fraction comprising $C_1$ to $C_3$ hydrocarbons from the product of the octane restoration reaction zone and recycling them to the hydrodesulfurization reaction zone.

12. The process as claimed in claim 10 which further comprises separating a hydrocarbon fraction comprising $C_1$ to $C_3$ hydrocarbons and recycling the $C_1$ to $C_3$ hydrocarbons to the octane restoration reaction zone.

13. The process as claimed in claim 10 which further comprises separating a fraction comprising $C_1$ to $C_3$ hydrocarbons from the product of the octane restoration reaction zone and recycling the $C_1$ to $C_3$ fraction to at least one of the reaction zones.

14. The process as claimed in claim 10 in which a benzene-rich stream is introduced to the octane restoration reaction zone.

15. The process as claimed in claim 10 in which said feed fraction comprises a naphtha fraction having a 95 percent point of at least about 380° F.

16. The process as claimed in claim 10 in which the acidic catalyst of the octane restoration reaction zone comprises an intermediate pore size zeolite.

17. The process as claimed in claim 10 in which the intermediate pore size. zeolite has the topology of ZSM-5 and is in the aluminosilicate form.

18. The process as claimed in claim 14 in which the benzene-rich stream is a reformate fraction.

* * * * *

UNITED STATES PATENT AND TRADEMARK OFFICE

CERTIFICATE OF CORRECTION

PATENT NO. : 5,326,463

DATED : July 5, 1994

INVENTOR(S) : David L. Fletcher et al.

It is certified that error appears in the above-indentified patent and that said Letters Patent is hereby corrected as shown below:

Col. 12, line 52, Claim 1, "325%" should read --325°F--.

Col. 12, line 66, Claim 1, "produce" should read --product--.

Col. 14, line 3, Claim 10, "produce" should read --product--.

Signed and Sealed this

Fourth Day of October, 1994

*Attest:*

*Attesting Officer*

Bruce Lehman

BRUCE LEHMAN

*Commissioner of Patents and Trademarks*